US010450844B2

(12) United States Patent
Kim et al.

(10) Patent No.: US 10,450,844 B2
(45) Date of Patent: Oct. 22, 2019

(54) DRAINAGE LAYERS FOR SAND CONTROL SCREEN ASSEMBLIES

(71) Applicant: Chevron U.S.A. Inc., San Ramon, CA (US)

(72) Inventors: Namhyo Kim, Houston, TX (US); Antonio Lazo, Houston, TX (US); Elaine Lange, Bellaire, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 216 days.

(21) Appl. No.: 15/353,416

(22) Filed: Nov. 16, 2016

(65) Prior Publication Data

US 2017/0362921 A1 Dec. 21, 2017

Related U.S. Application Data

(60) Provisional application No. 62/350,478, filed on Jun. 15, 2016, provisional application No. 62/403,954, filed on Oct. 4, 2016.

(51) Int. Cl.
*E21B 43/08* (2006.01)

(52) U.S. Cl.
CPC ..... *E21B 43/086* (2013.01); *E21B 43/082* (2013.01); *E21B 43/084* (2013.01)

(58) Field of Classification Search
CPC ..... E21B 43/086; E21B 43/08; E21B 43/082; E21B 43/084
See application file for complete search history.

(56) References Cited

U.S. PATENT DOCUMENTS 5,355,956 A * 10/1994 Restarick ..... E21B 43/082 166/229
8,701,757 B2 * 4/2014 Greci ..... E21B 43/088 166/227
2012/0073801 A1 * 3/2012 Greci ..... E21B 43/08 166/227
2015/0144330 A1 * 5/2015 Noblett ..... E21B 33/1277 166/244.1

FOREIGN PATENT DOCUMENTS

JP 2007126888 A 5/2007
WO WO-2014/137332 * 9/2014
WO 2017039840 A1 3/2017

* cited by examiner

*Primary Examiner* — Nicole Coy
(74) *Attorney, Agent, or Firm* — King & Spalding LLP

(57) ABSTRACT

A sand control screen assembly having a drainage layer that provides a controlled offset between the drainage layer and a filter medium and/or a base pipe. The sand control screen assembly also includes a protective shroud or jacket positioned about the filter medium. The sand control screen assembly can be utilized for preventing the flow of particulate material of a predetermined size therethrough and allowing the flow of production fluids therethrough.

25 Claims, 22 Drawing Sheets

DRAINAGE LAYERS FOR SAND CONTROL SCREEN ASSEMBLIES

CROSS-REFERENCE TO RELATED APPLICATIONS

This application claims priority under 35 U.S.C. § 119 to U.S. Provisional Patent Application Ser. No. 62/350,478, titled "Drainage Layers For Sand Control Screen Assemblies" and filed on Jun. 15, 2016, and to U.S. Provisional Patent Application Ser. No. 62/403,954, titled "Drainage Layers For Sand Control Screen Assemblies" and filed on Oct. 4, 2016, the entire contents of which are hereby incorporated herein by reference.

TECHNICAL FIELD

The present application relates generally to structures adapted for filtering particulates from a flowing fluid in a wellbore that traverse a subterranean hydrocarbon bearing formation, and in particular, to drainage layers for sand control screen assemblies.

BACKGROUND

Sand exclusion screen assemblies are employed in wellbores during the production of hydrocarbon fluids from subterranean formations. Conventional sand screen assemblies include a perforated base pipe, a drainage layer, a filter medium, and a protective jacket or shroud. Such screen assemblies are designed to filter out particles, such as formation sand or placed gravel/proppant, while facilitating the passage of hydrocarbon fluids into the wellbore. One drawback in the deployment of such screen assemblies is that the drainage layer, which is usually positioned between the filter medium and the base pipe, is that the large contact area between conventional drainage layers and the filter medium tends to generate flow resistance. In addition, the conventional drainage layers utilizing a wire-wrap configuration generally have flow blockage or channeling caused by the existence of spacer ribs. The flow resistance or blockage could result in an unwanted localized erosion failure of the sand control screen assembly. When erosion occurs, then particles are produced from the well, which is highly undesirable. Production of these particles can cause excessive erosion of production tubulars, downhole equipment and surface equipment, and lead to high maintenance costs and undesirable downtime of wells.

Accordingly, a need has arisen for a sand control screen assembly that is capable of filtering fines out of a production stream from a subterranean hydrocarbon bearing formation and that does not readily suffer from erosion.

SUMMARY

The present application is generally related to drainage layers for sand control screen assemblies for filtering particulates from a flowing fluid in a wellbore that traverses a subterranean hydrocarbon bearing formation.

In an example embodiment, a sand control screen assembly includes a perforated base pipe and a perforated drainage layer disposed about the base pipe. The drainage layer includes multiple protrusions extending from the inner and/or outer surface of the drainage layer. In instances where protrusions extend from the inner surface of the drainage layer, the protrusions provide substantially uniform radial spacing between the drainage layer and the base pipe. The sand control screen assembly may also include a filter medium positioned about the drainage layer. In instances where protrusions extend from the outer surface of the drainage layer, the protrusions provide substantially uniform radial spacing between the drainage layer and the filter medium.

In another example embodiment, a sand control screen assembly includes a perforated base pipe, a drainage layer disposed about the base pipe, and an offset means for providing a radial spacing relative to the drainage layer's inner surface. Generally, the offset means can be oriented longitudinally, circumferentially, or helically along the drainage layer's inner surface. In certain instances, the offset means includes a plurality of ribs.

In yet another example embodiment, a sand control screen assembly includes a perforated base pipe, a drainage layer having openings through a thickness of the drainage layer, where the drainage layer is disposed about the base pipe, a filter medium disposed about the drainage layer, and inserts positioned in one or more of the openings of the drainage layer. The inserts can provide a radial offset between the filter medium and the drainage layer and/or between the base pipe and the drainage layer. The inserts can include an internal opening allowing for flow communication from an exterior of the drainage layer to an interior of the drainage layer.

These and other aspects, objects, features, and embodiments will be apparent from the following description and the appended claims.

DETAILED DESCRIPTION

Figure 1:
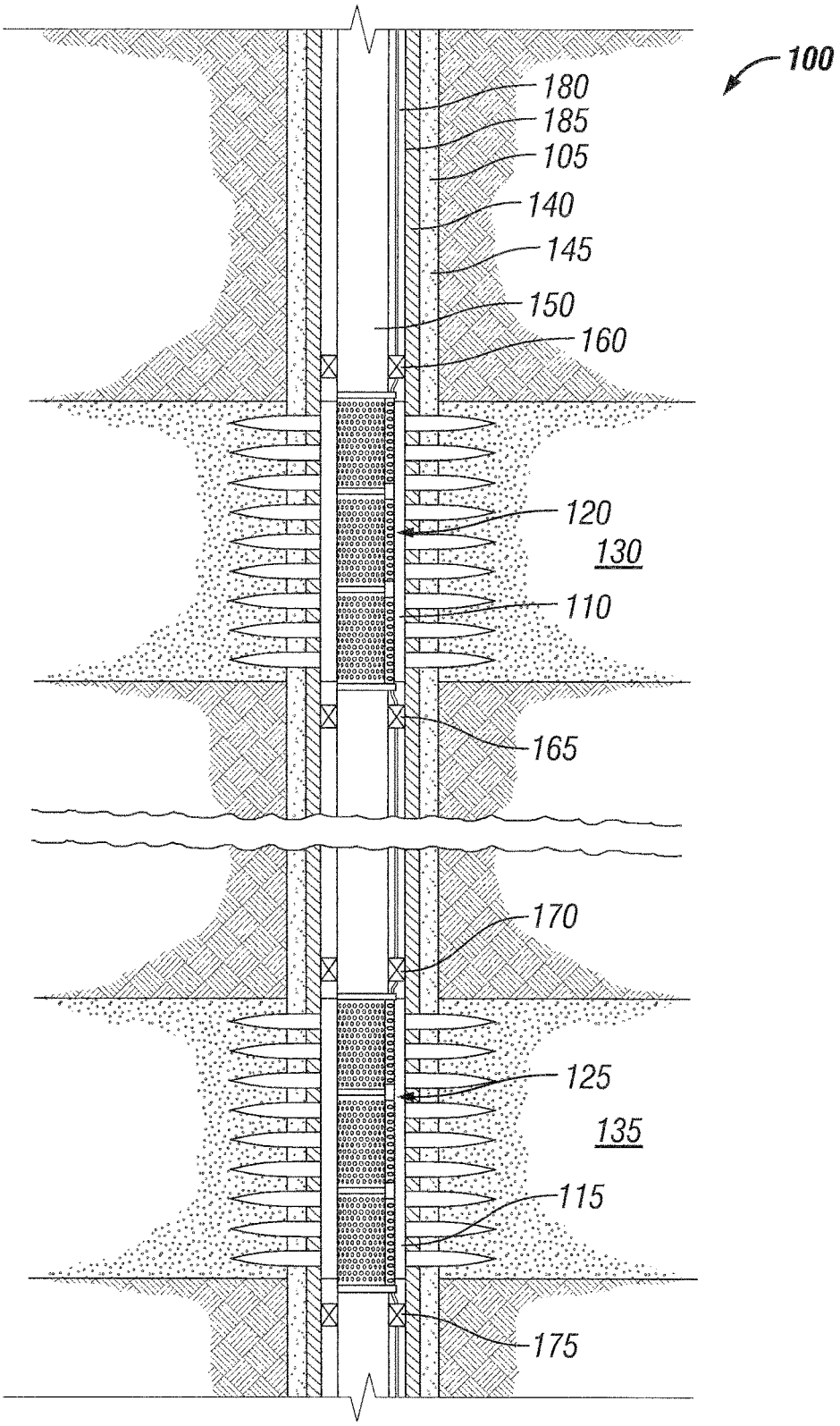
FIG. 1 is a schematic illustration of a wellbore environment including a pair of sand control screen assemblies, according to an embodiment of the present invention.
Figure 2A:
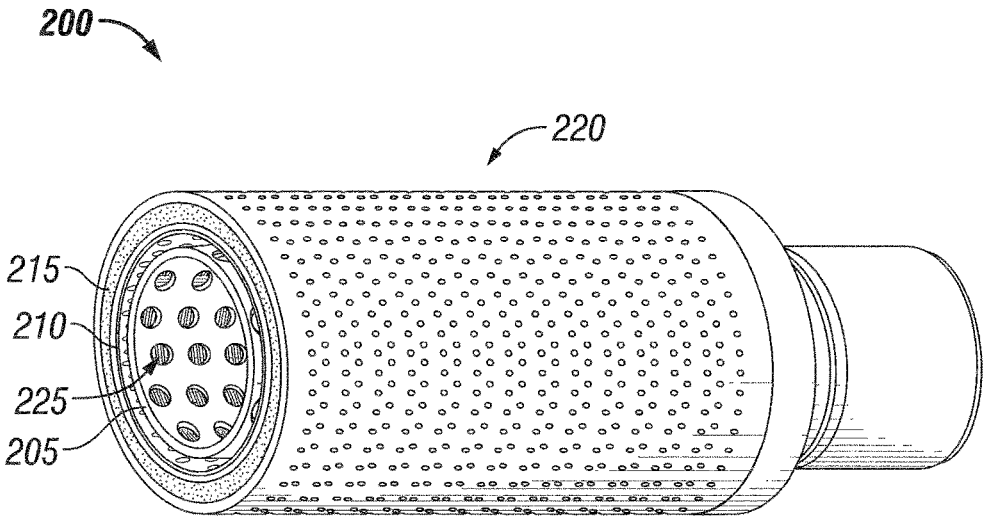
FIG. 2A is a top perspective view of a sand control screen assembly, according to an embodiment of the present invention.
Figure 2B:
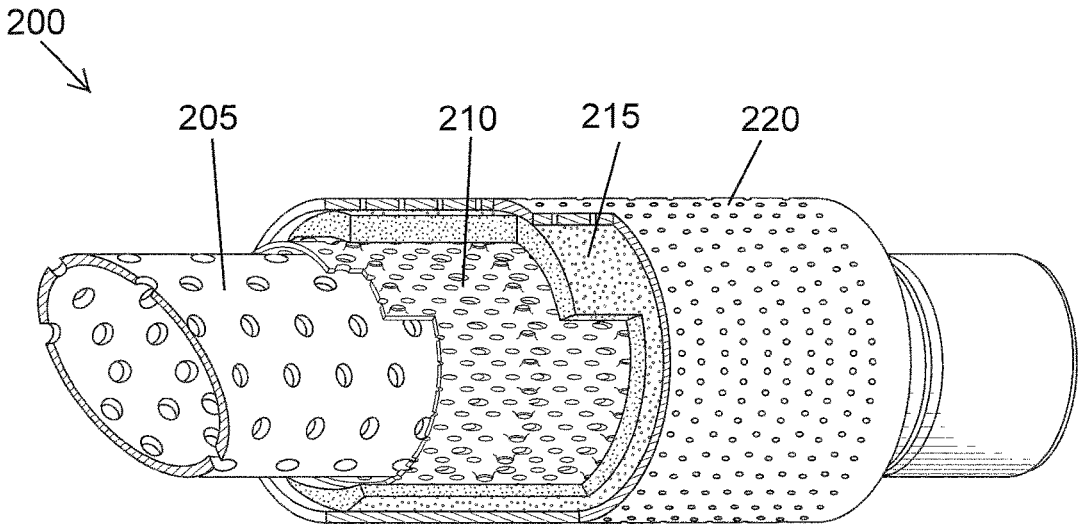
FIG. 2B is a partial cut away view of the sand control screen assembly of FIG. 2A, according to an embodiment of the present invention.
Figure 2C:
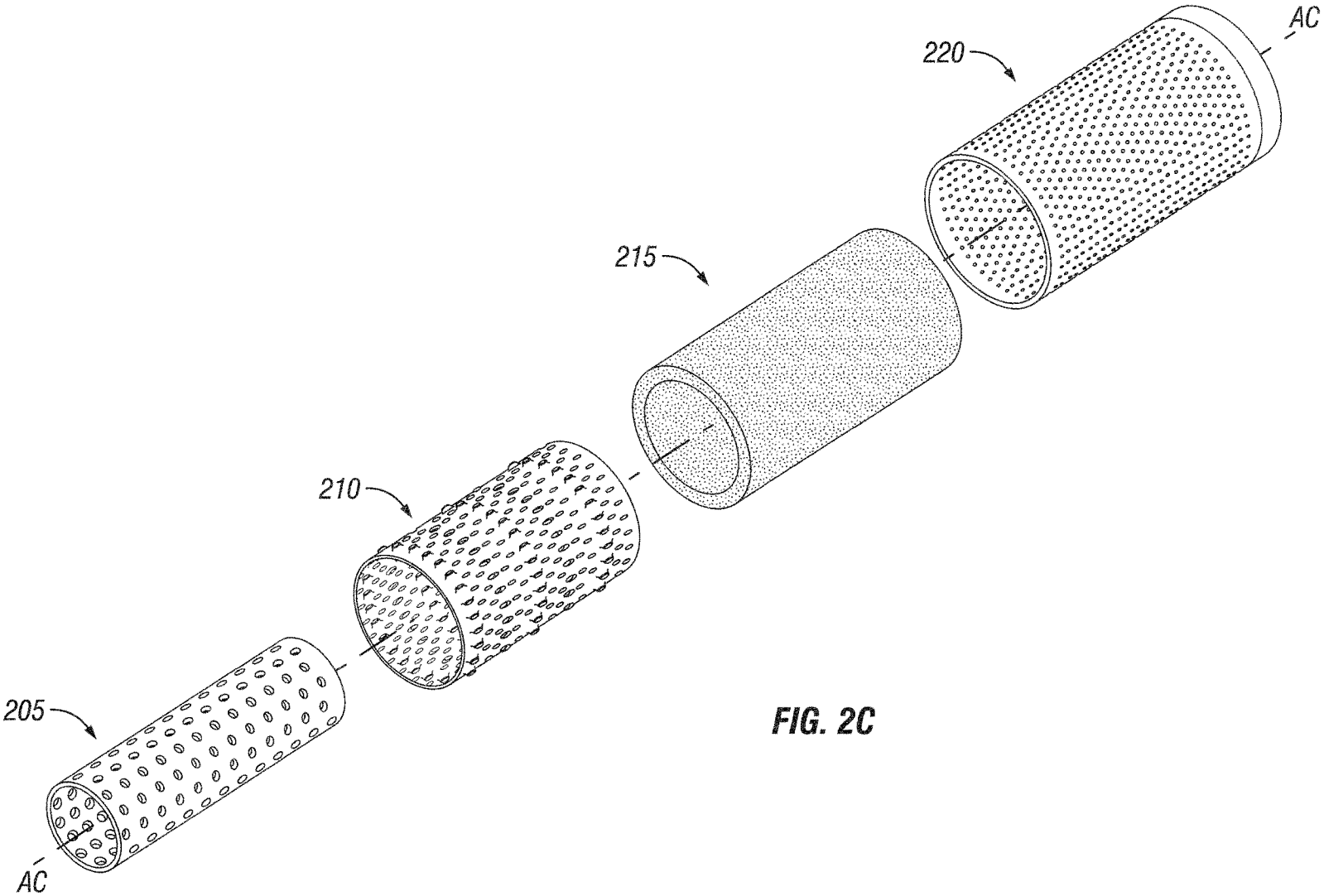
FIG. 2C is an exploded view of the sand control screen assembly of FIG. 2A, according to an embodiment of the present invention.
Figure 2D:
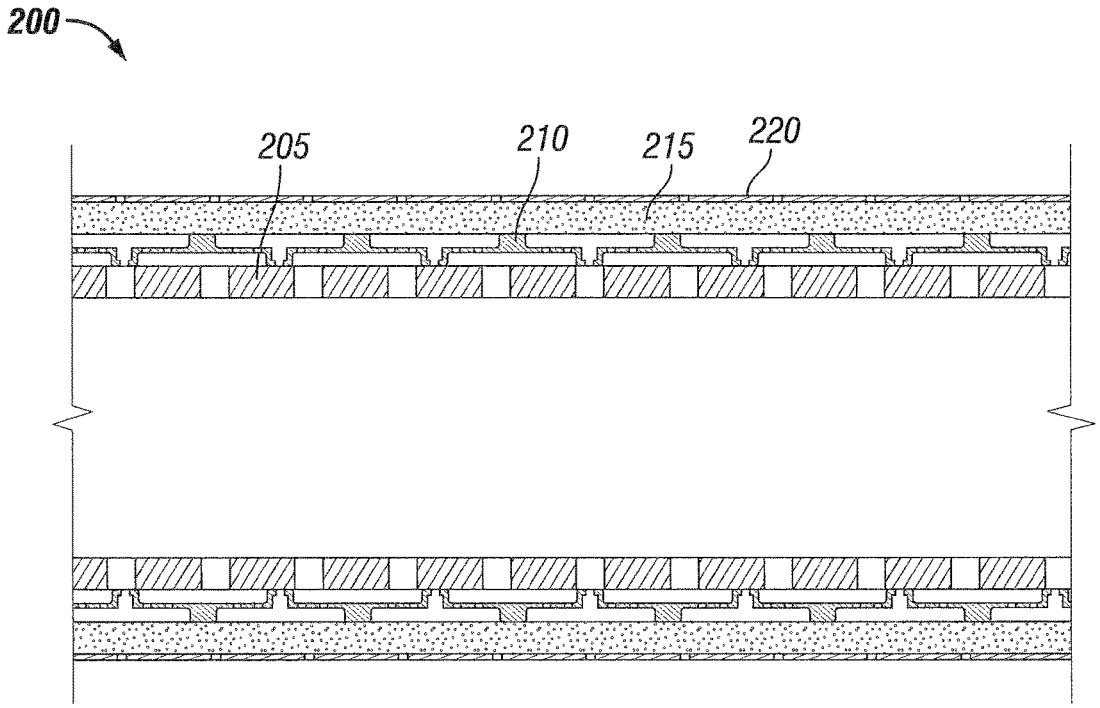
FIG. 2D is a side cross-sectional view of the sand control screen assembly of FIG. 2A, according to an embodiment of the present invention.
Figure 3A:
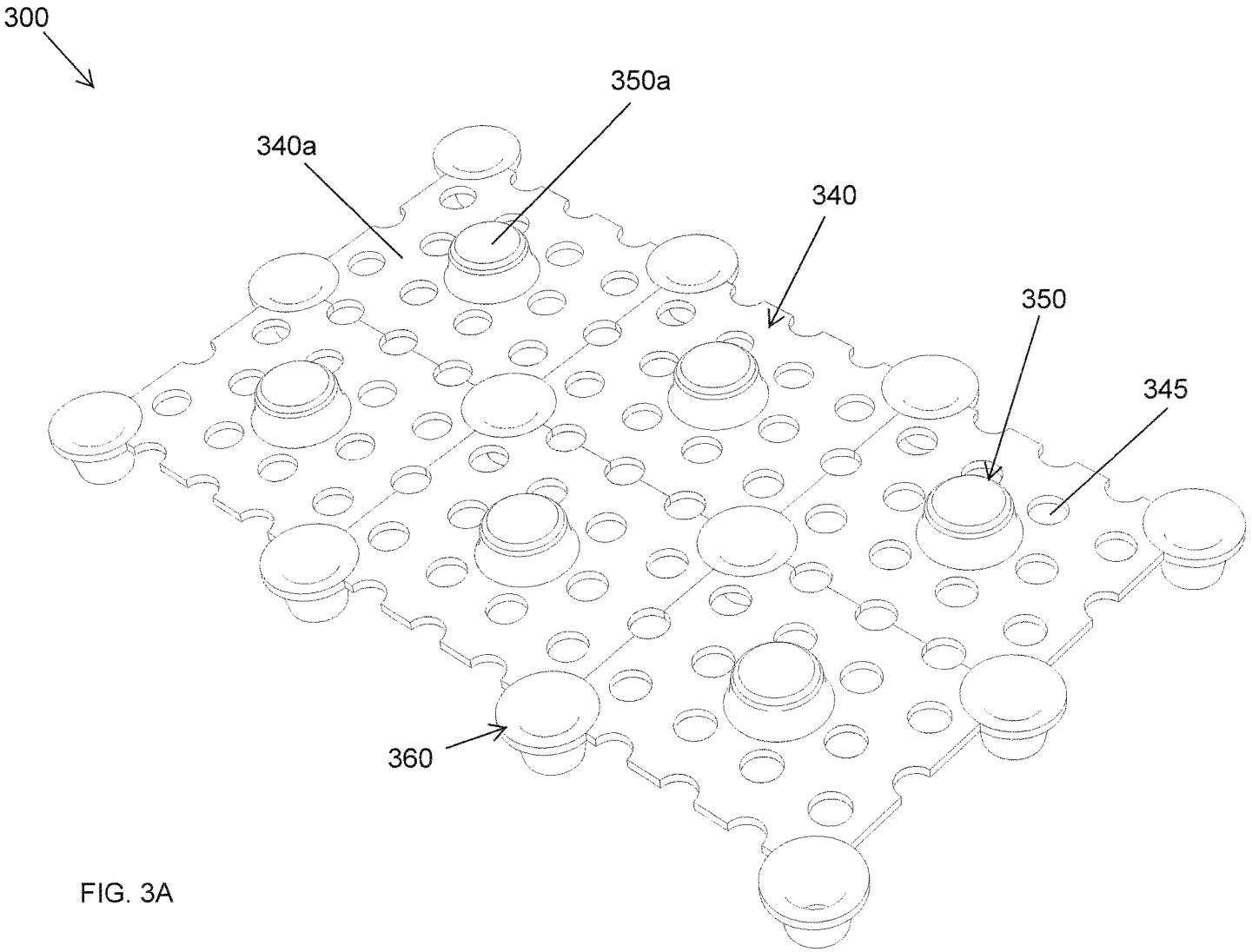
FIG. 3A is a perspective view of a section of a drainage layer for a sand control screen assembly, according to an embodiment of the present invention.
Figure 3B:
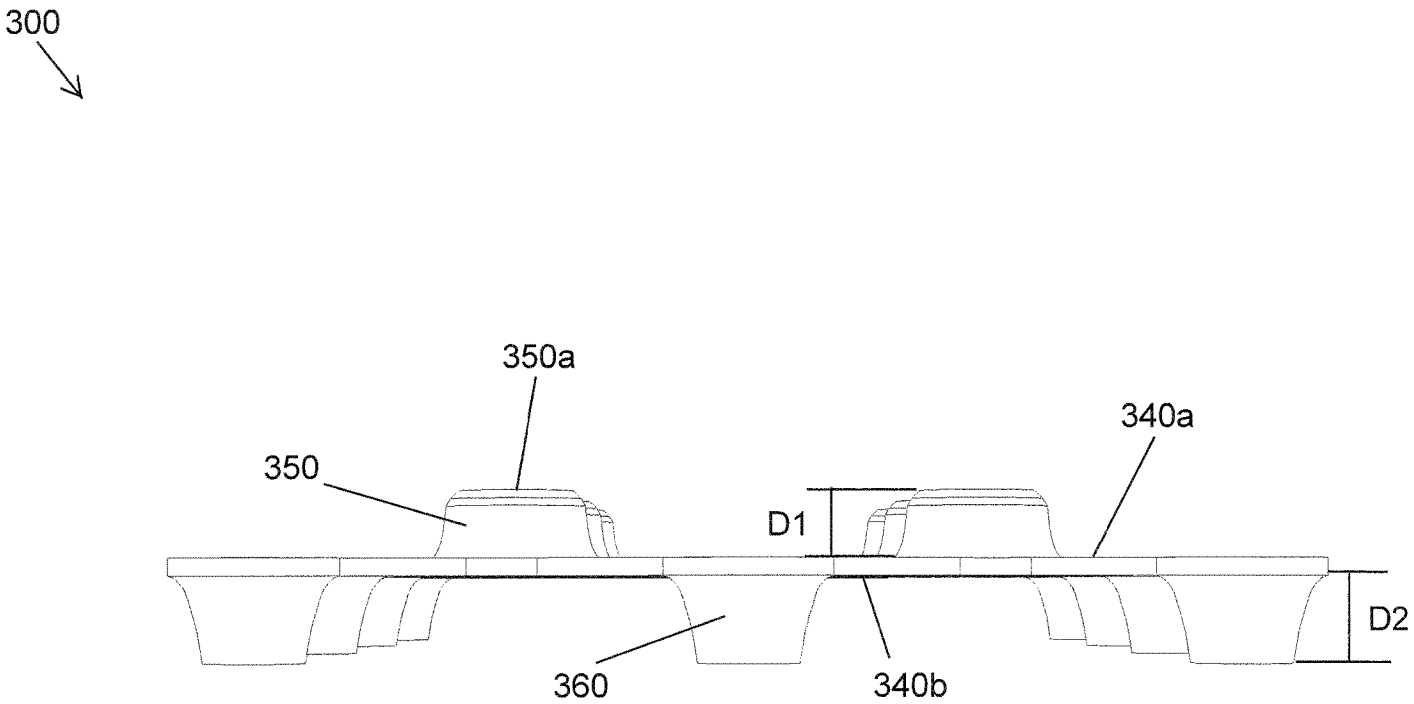
FIG. 3B is a side view of the drainage layer section of FIG. 3A, according to an embodiment of the present invention.
Figure 3C:
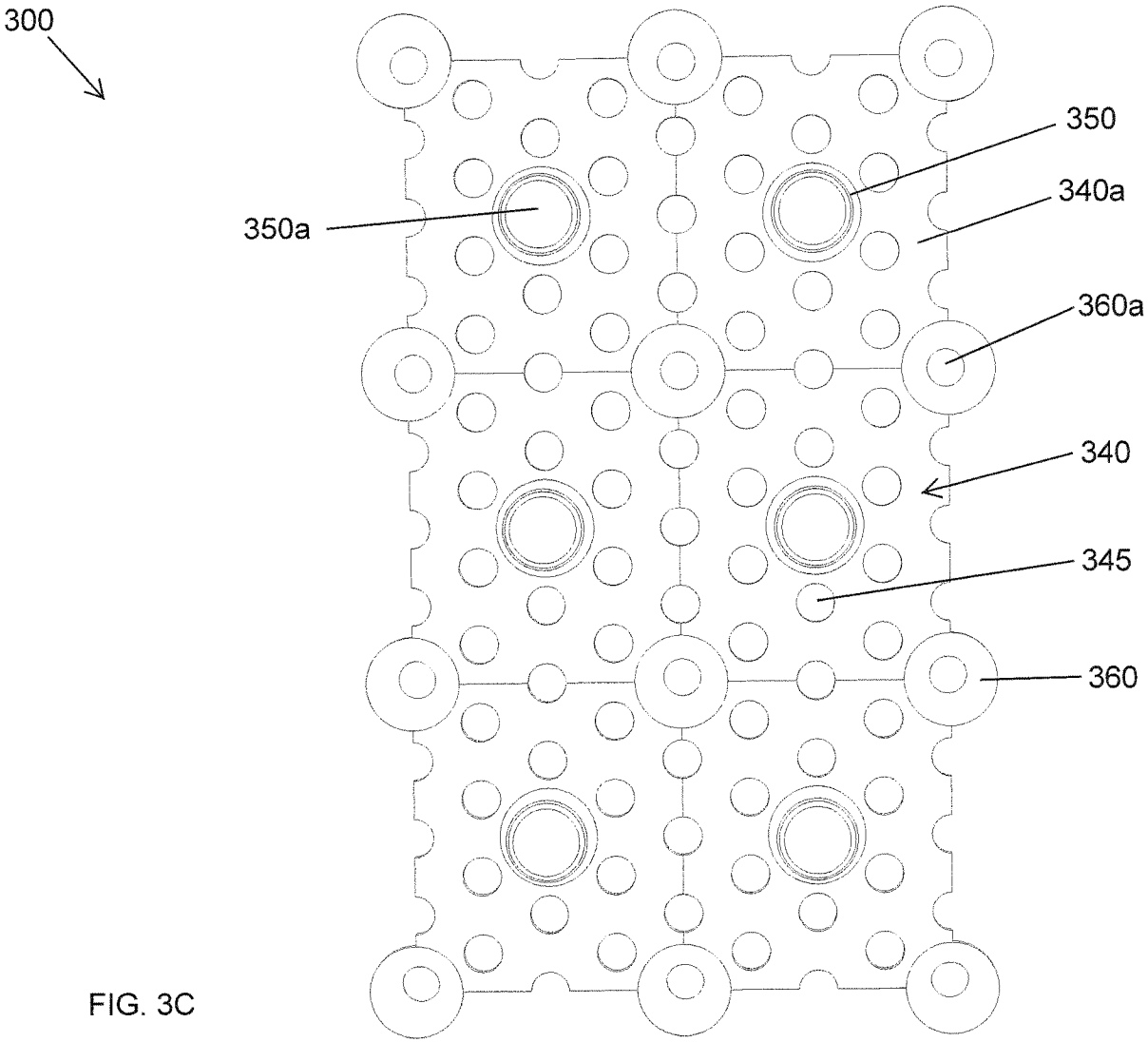
FIG. 3C is a top view of the drainage layer section of FIG. 3A, according to an embodiment of the present invention.
Figure 3D:
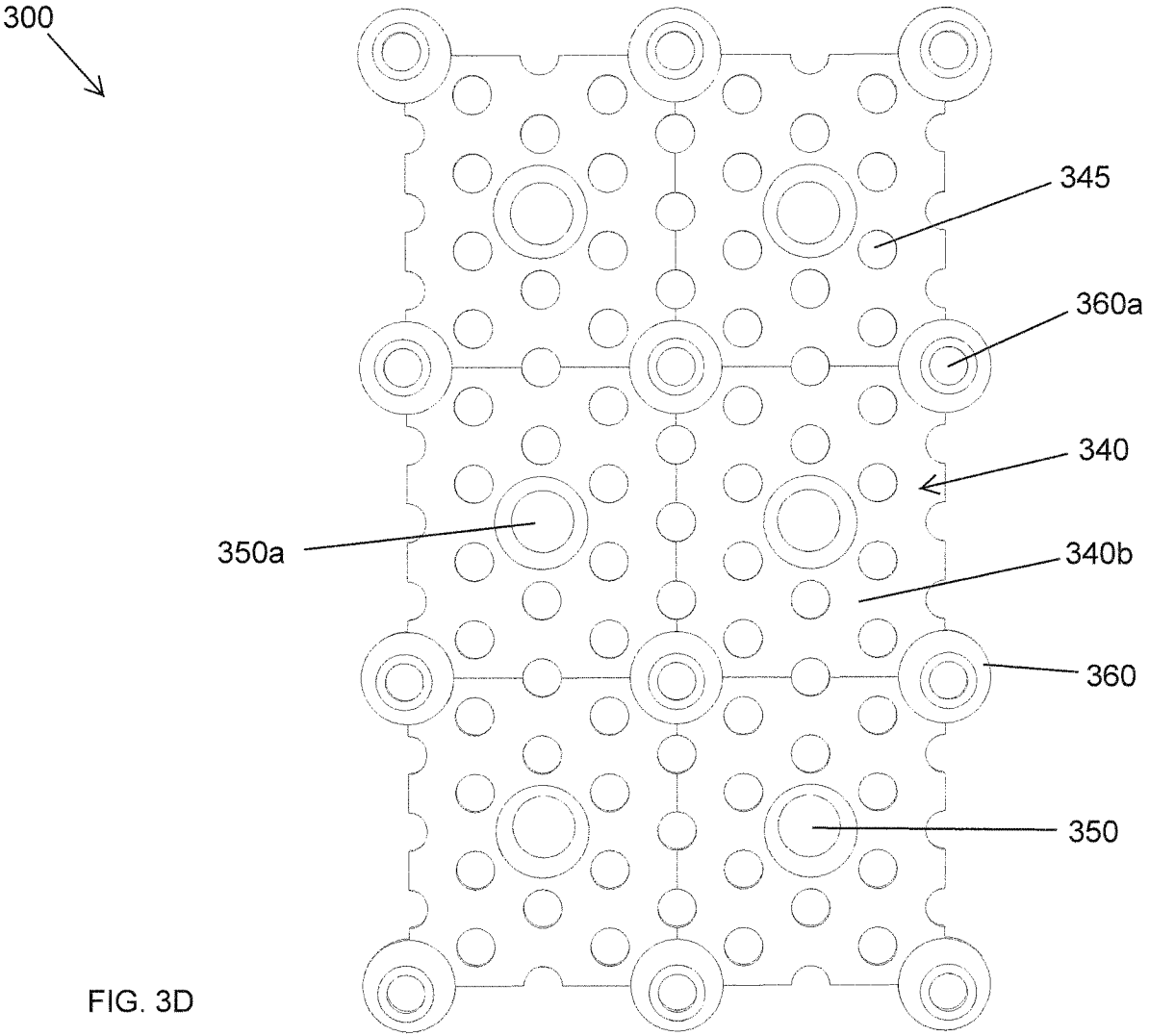
FIG. 3D is a bottom view of the drainage layer section of FIG. 3A, according to an embodiment of the present invention.
Figure 4A:
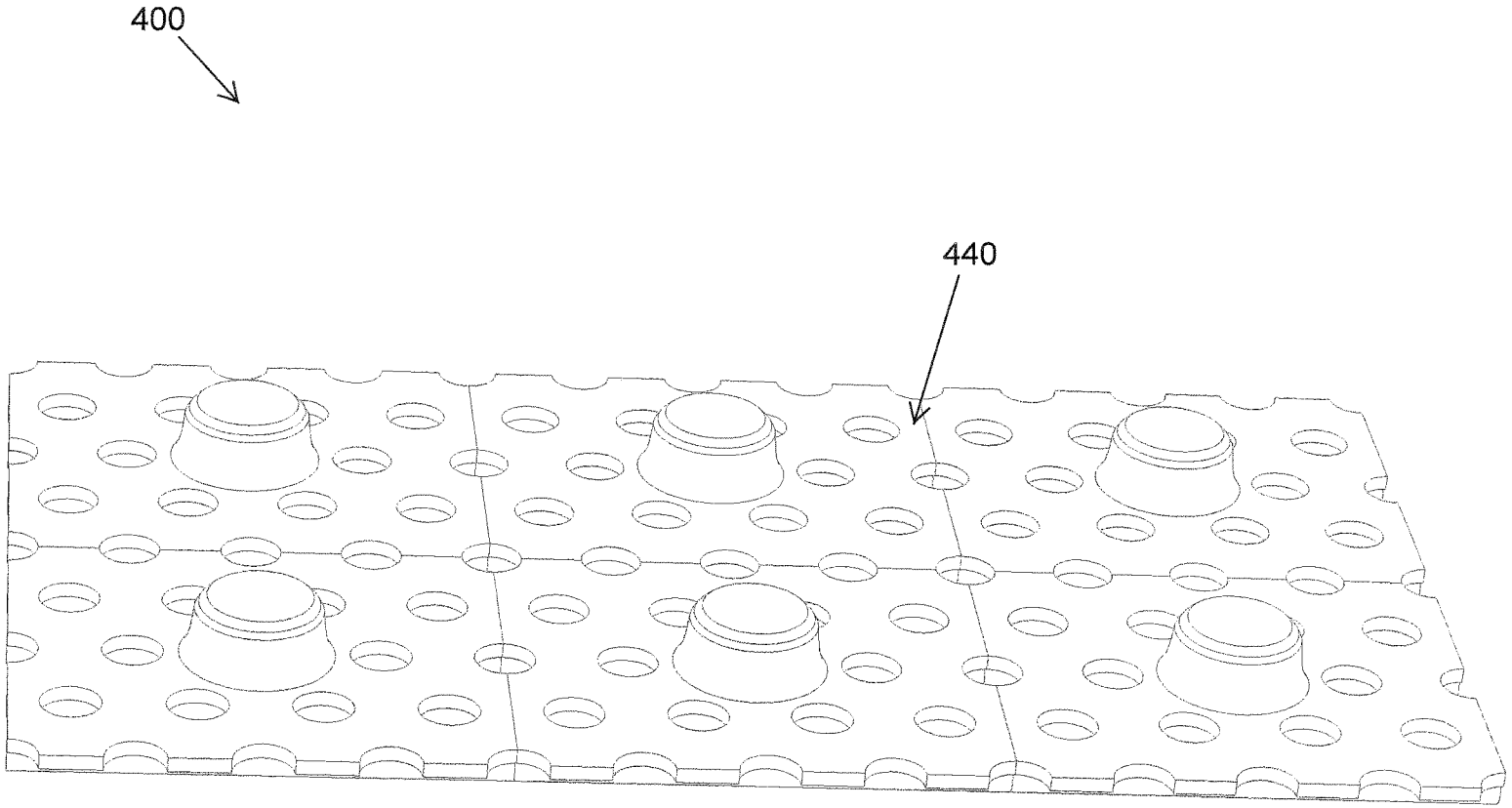
FIG. 4A is a perspective view of a section of another drainage layer for a sand control screen assembly, according to an embodiment of the present invention.
Figure 4B:
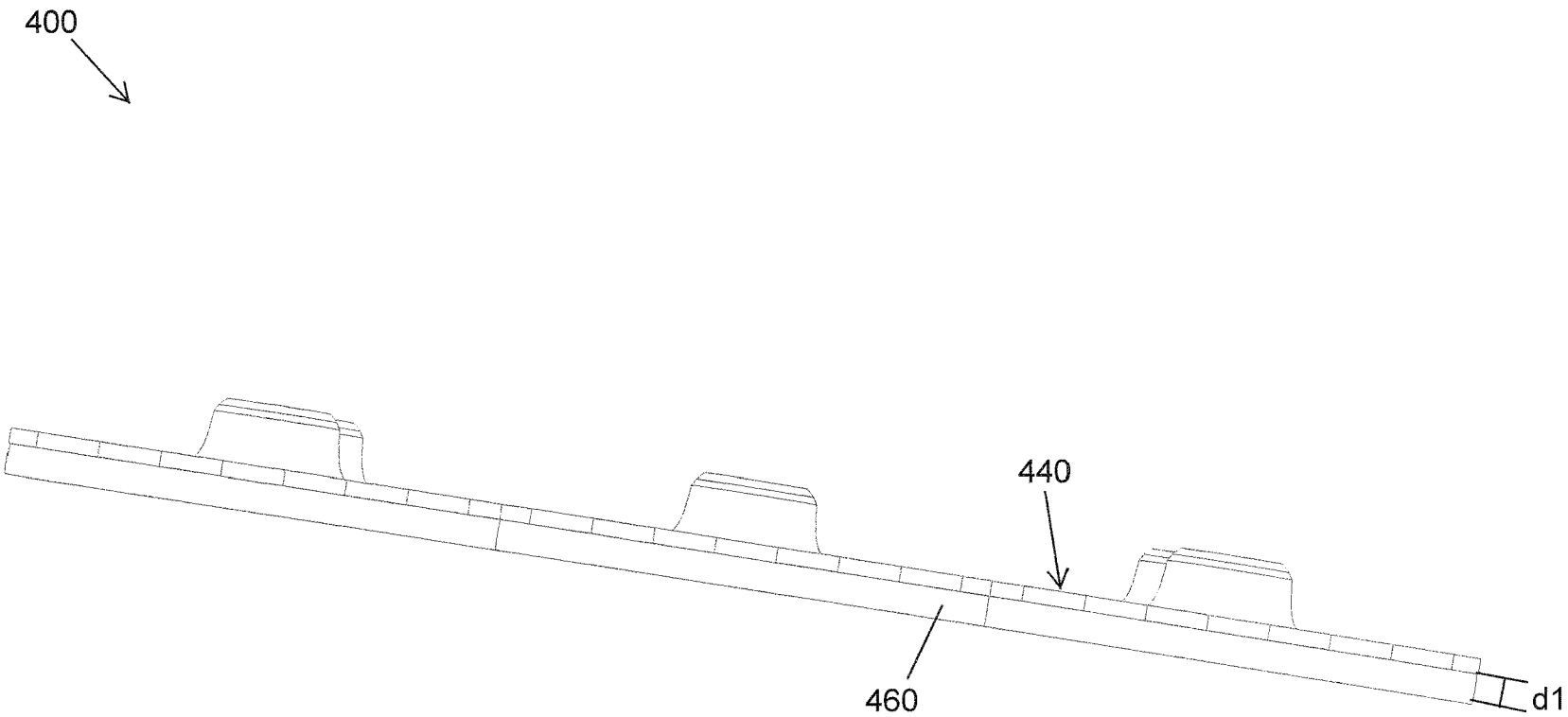
FIG. 4B is a side view of the drainage layer section of FIG. 4A, according to an embodiment of the present invention.
Figure 4C:
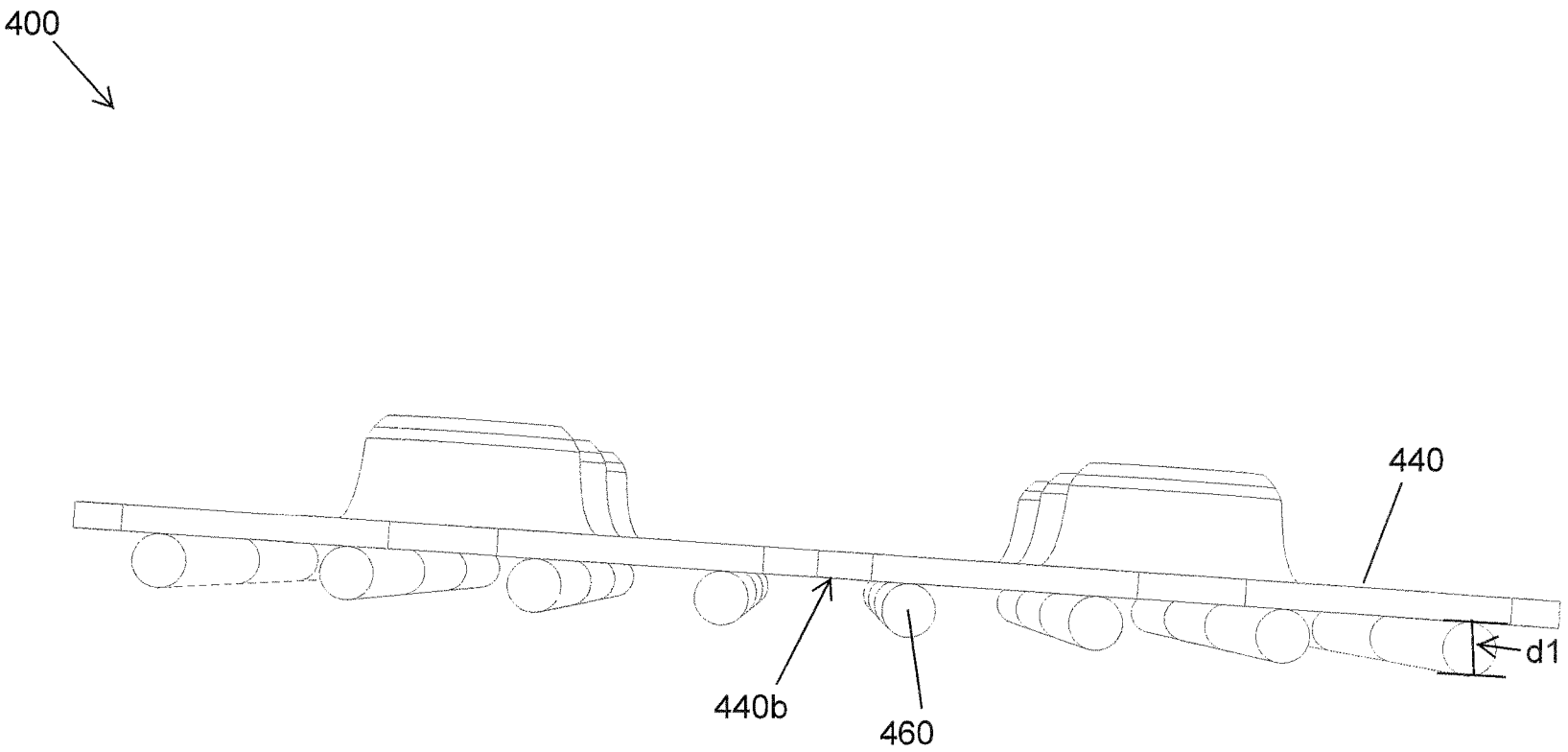
FIG. 4C is another side view of the drainage layer section of FIG. 4A, according to an embodiment of the present invention.
Figure 4D:
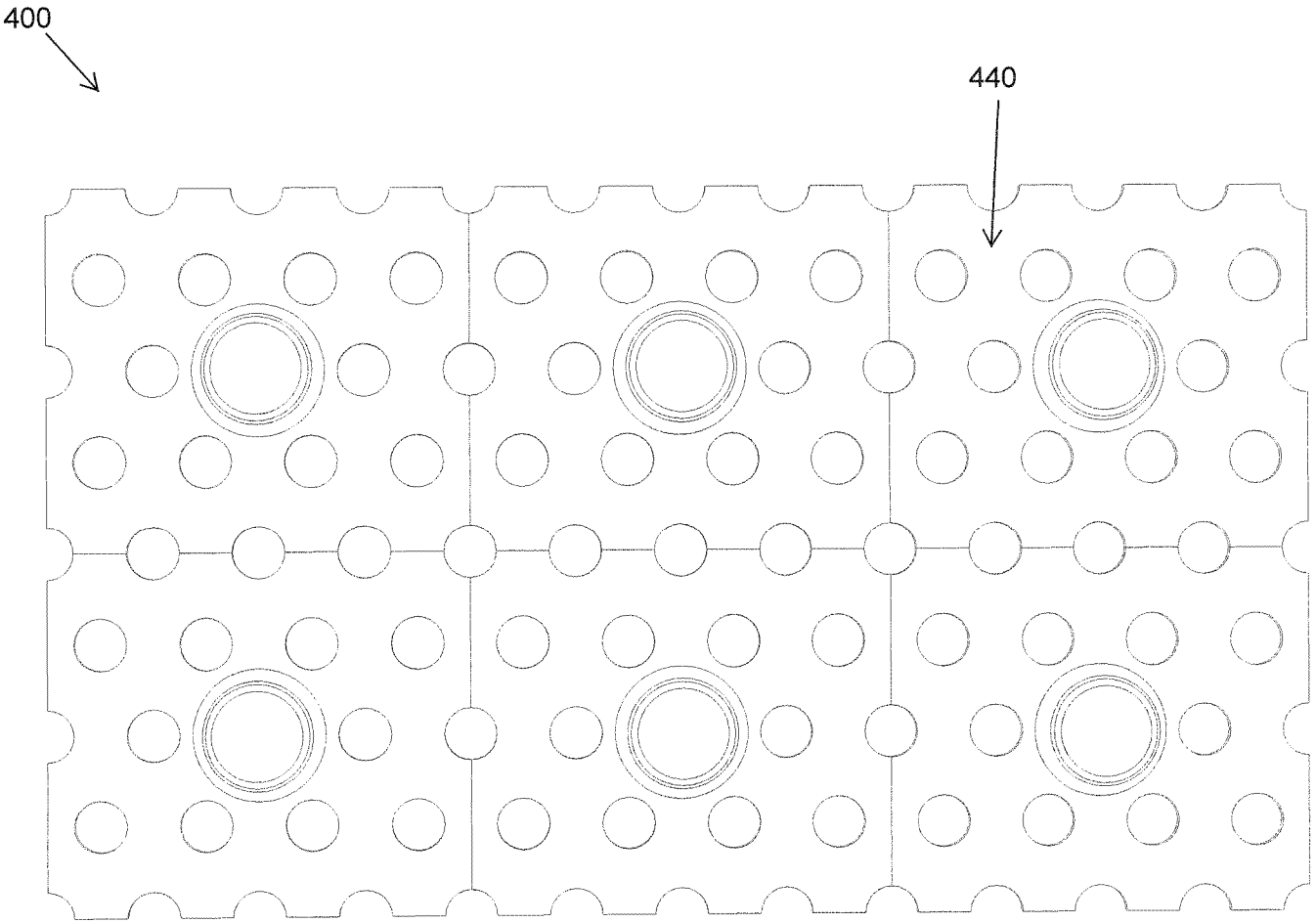
FIG. 4D is a top view of the drainage layer section of FIG. 4A, according to an embodiment of the present invention.
Figure 4E:
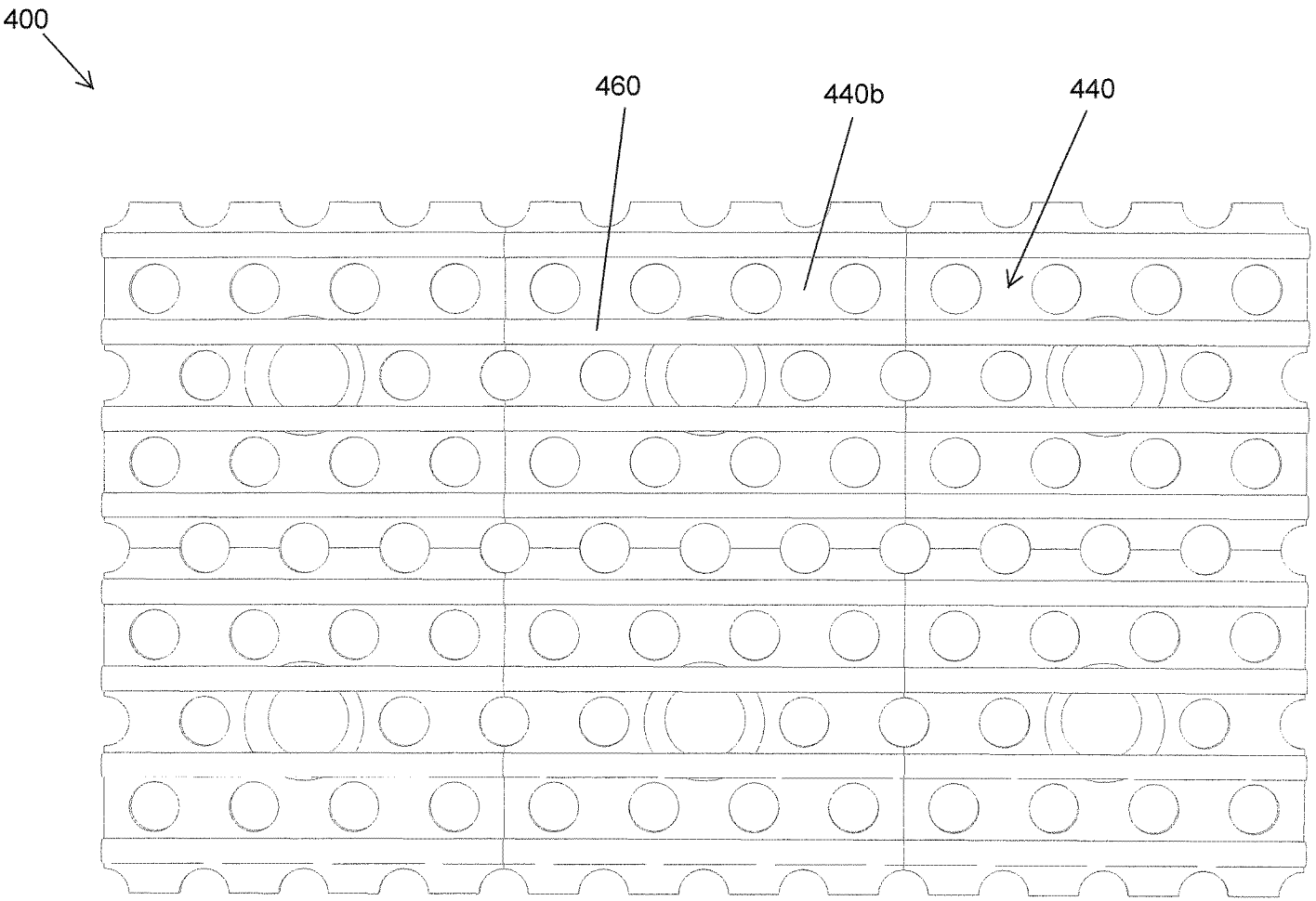
FIG. 4E is a bottom view of the drainage layer section of FIG. 4A, according to an embodiment of the present invention.
Figure 5A:
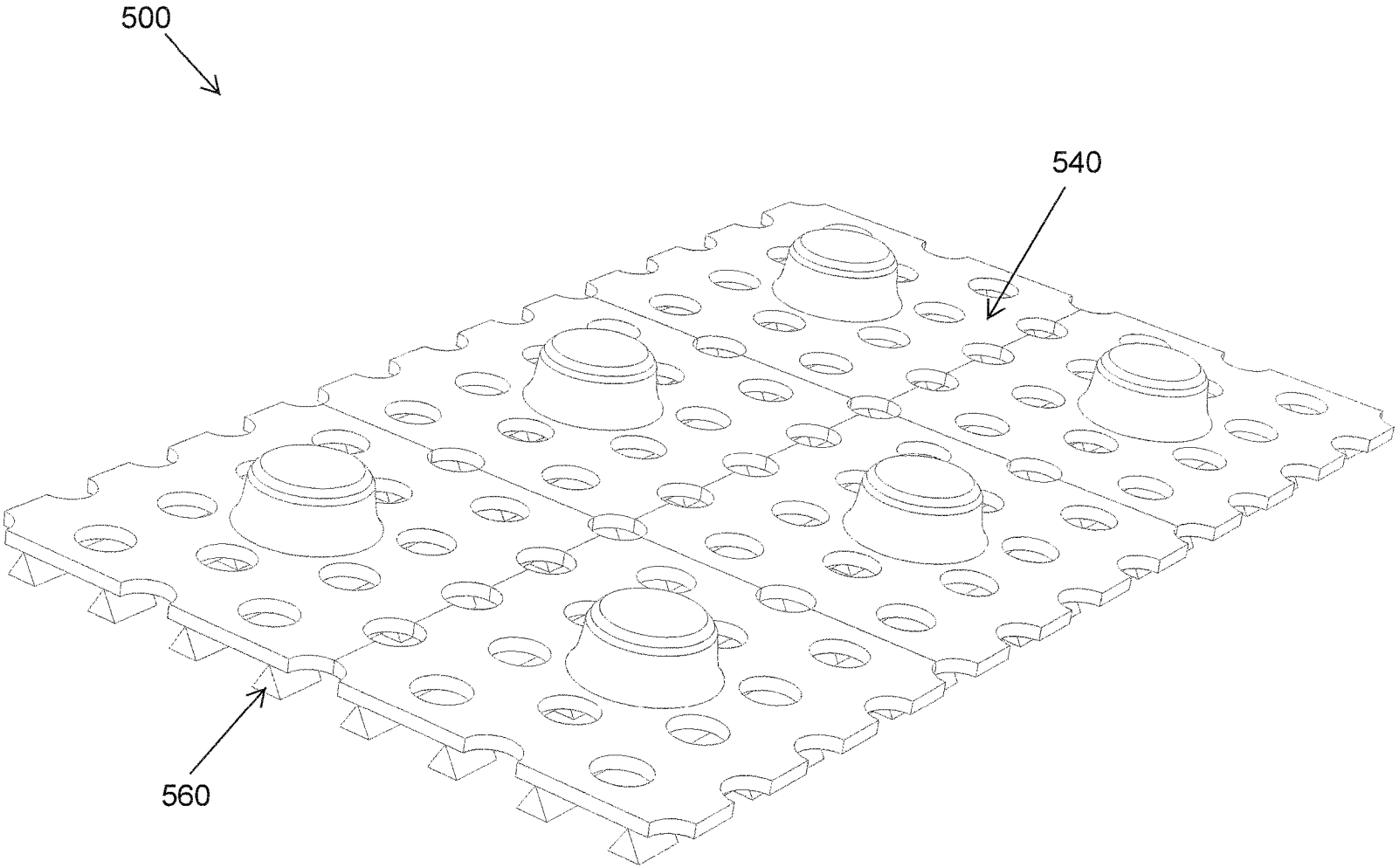
FIG. 5A is a perspective view of a section of yet another drainage layer for a sand control screen assembly, according to an embodiment of the present invention.
Figure 5B:
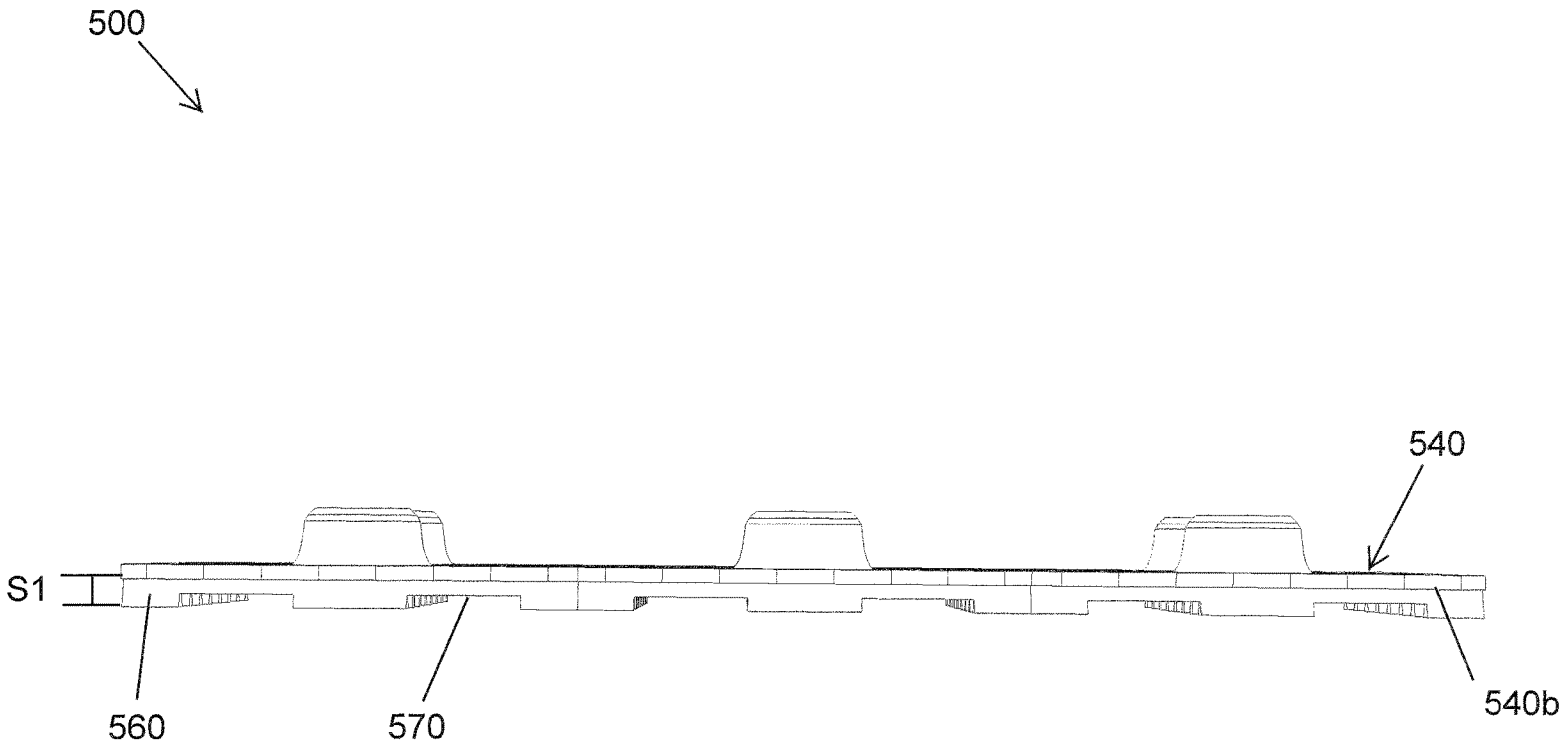
FIG. 5B is a side view of the drainage layer section of FIG. 5A, according to an embodiment of the present invention.
Figure 5C:
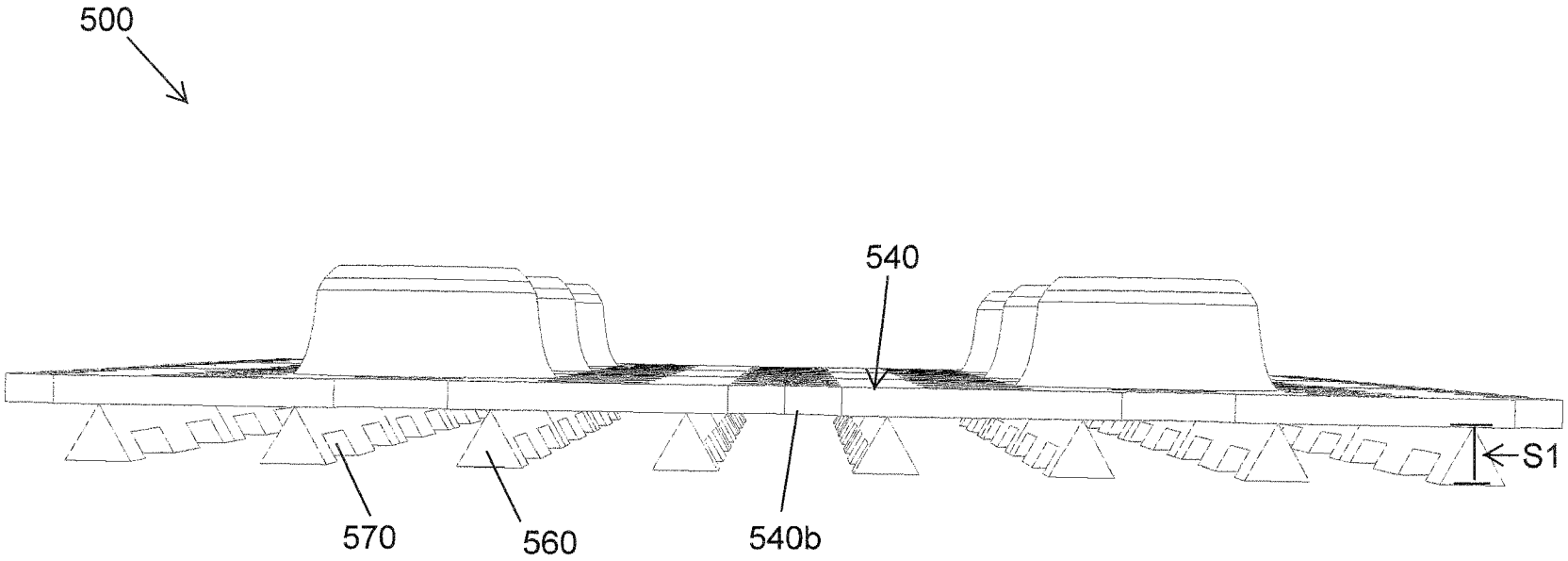
FIG. 5C is another side view of the drainage layer section of FIG. 5A, according to an embodiment of the present invention.
Figure 5D:
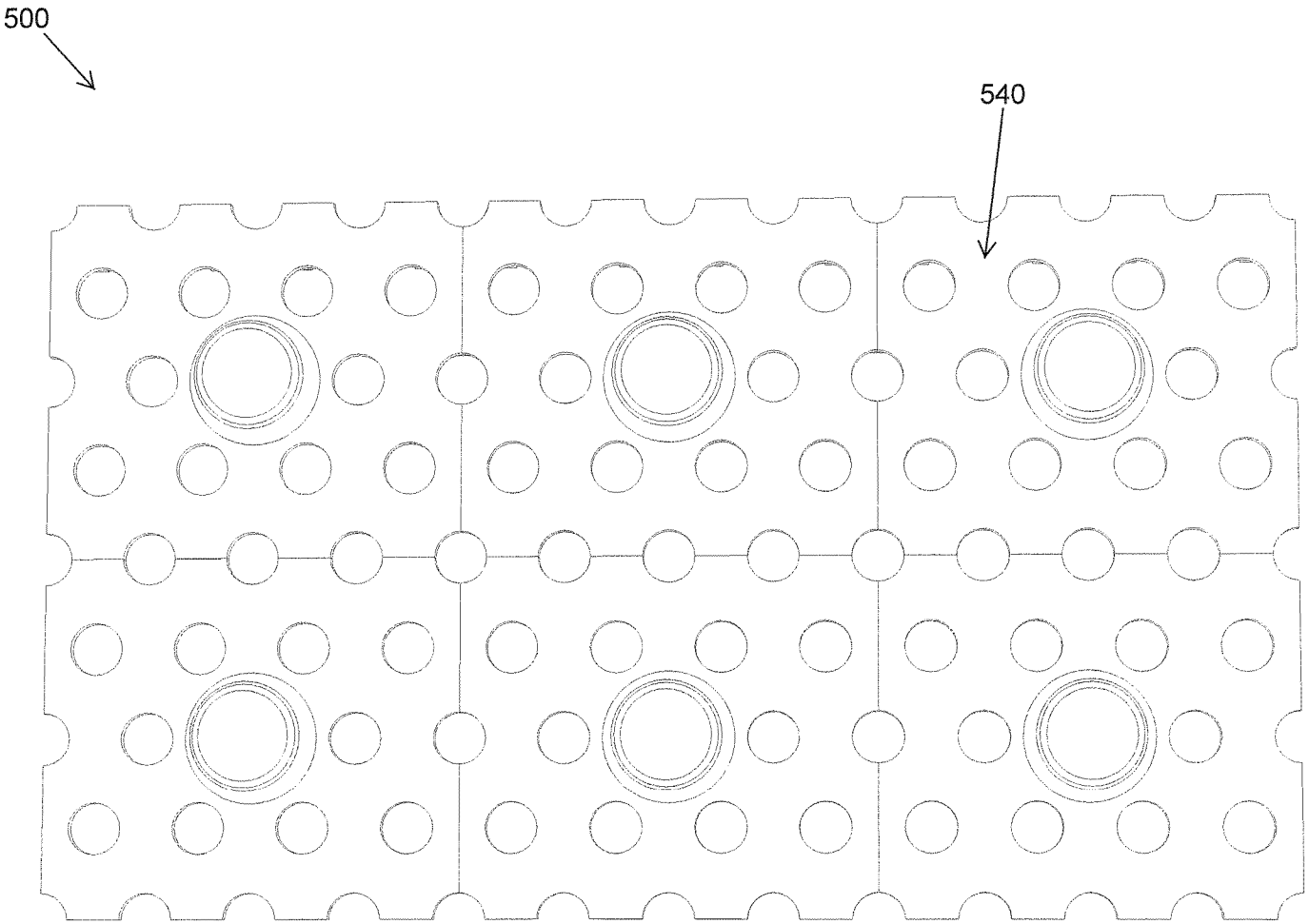
FIG. 5D is a top view of the drainage layer section of FIG. 5A, according to an embodiment of the present invention.
Figure 5E:
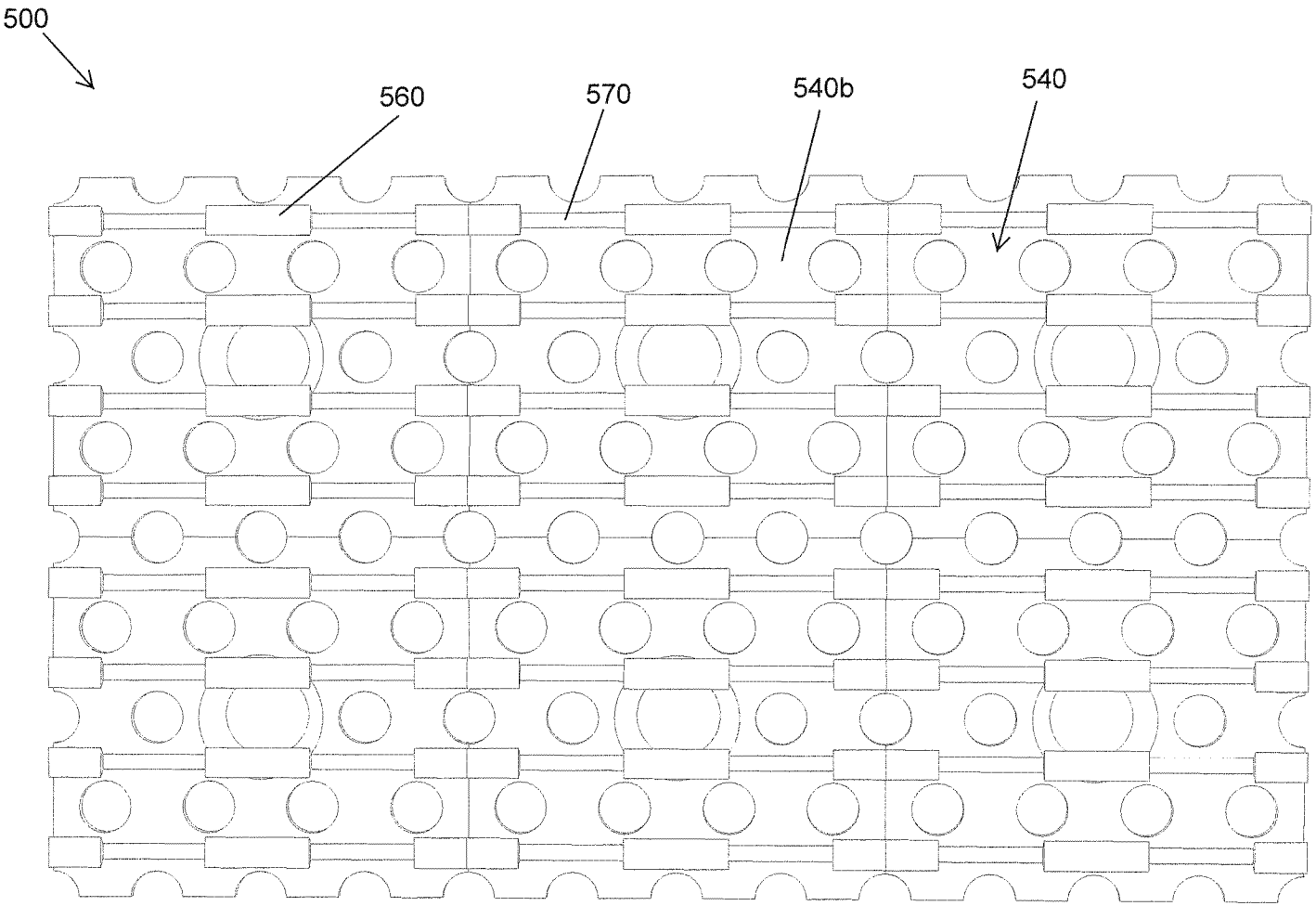
FIG. 5E is a bottom view of the drainage layer section of FIG. 5A, according to an embodiment of the present invention.

The present application provides sand control screen assemblies that are more resistant to erosion than conventional sand control screen assemblies. By limiting erosion loss, it is not required to reduce the rate of oil and gas production, which is common in instances of sand screen erosion.

The invention may be better understood by reading the following description of non-limitative, exemplary embodiments with reference to the attached drawings, wherein like parts of each of the figures are identified by the same reference characters. In the following description of the representative embodiments of the invention, directional terms, such as "above", "below", "upper", "lower", "top", "bottom", "inner", "outer", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore towards the bottom of well.

Referring to FIG. 1, illustrated is a wellbore system 100 that may employ the principles of the present disclosure, according to one or more embodiments of the disclosure. As depicted, the wellbore system 100 includes a wellbore 105 having production intervals 110, 115, having sand control screen assemblies 120, 125, respectively, positioned therein. The wellbore 105 extends through various formations 130, 135 in the earth strata. A casing 140 is supported within wellbore 105 by cement 145. A production or completion string 150 includes various tools, such as sand control screen assembly 120 that is positioned within production interval 110 between packers 160, 165. In addition, the production or completion string 150 includes a sand control screen assembly 125 that is positioned within production interval 115 between packers 170, 175. The sand control screen assemblies 120, 125 serve the primary functions of filtering particulate matter out of the production fluid stream and may also include flow control capabilities or other additional functionality. One or more control lines 180 may extend from a ground surface within annulus 185 and pass through sand control screen assemblies 120, 125 to provide instructions, carry power, signals and data, and transport operating fluid, such as hydraulic fluid, to sensors, actuators and the like associated with sand control screen assemblies 120, 125 and other tools or components positioned downhole. Sensors (not shown) operably associated with production or completion string 150 may be used to provide valuable information to the operator via control line 180 during the production phase of the well, such as fluid temperature, pressure, velocity, constituent composition and the like, such that the operator can enhance the production operations.

Even though FIG. 1 depicts sand control screen assemblies 120, 125 in a cased hole environment, one skilled in the art will recognize that the sand control screen assemblies of the present invention are equally well suited for use in open hole environments. Also, even though FIG. 1 depicts a vertical completion, one skilled in the art will recognize that the sand control screen assemblies of the present invention are equally well suited for use in well having other directional configurations including horizontal wells, deviated wells, multilateral wells, and the like.

FIGS. 2A-2D illustrate an exemplary embodiment of a sand control screen assembly 200 for use in wellbore 105 (FIG. 1). Along with the other sand control screen assemblies described in the present application, the sand control screen assembly 200 may replace one or more of the screen assemblies 120, 125 described in FIG. 1 and may otherwise be used in the exemplary wellbore system 100 depicted therein.

The screen assembly 200 generally includes a perforated base pipe 205, a drainage layer 210, a filter medium 215, and a protective jacket or shroud 220. Generally, during hydrocarbon production, fluid from the subterranean formation flows in a direction from the formation, through the shroud 220, and towards a central axis Ac of the base pipe 205. The base pipe 205 provides structural support to the assembly 200, and also provides flow communication via openings 225 with the production or completion string 150 (FIG. 1) in the wellbore 105. The drainage layer 210 is placed around the surface of the base pipe 205 and typically distributes inflow to the base pipe 205. In certain embodiments, the drainage layer 210 also provides structural support between the filter medium 215 and the base pipe 205. The filter medium 215 that surrounds the drainage layer 210 is utilized for particle control and/or particle filtration of a predetermined size. The filter medium 215 is generally woven, wire-wrapped, or a slotted liner. The shroud 220 surrounds the filter medium 215 and provides protection to the assembly 200 during installation. In certain exemplary embodiments, the shroud 220 is a perforated jacket. In certain other embodiments, the shroud may be a screen jacket, a wire-wrapped jacket, or a stamped jacket.

FIGS. 3A-3D illustrate an exemplary embodiment of a section 300 of a drainage layer for a sand control screen assembly for use in a wellbore. The shapes of drainage layers shown in FIGS. 3A-3D, and other figures hereafter, are planar sheets before the deformation to wrap about the base pipe 205 in FIG. 2A, and are shown such for the purpose of easy visual demonstration. The drainage layer section 300 may be used to construct a cylindrical-shaped drainage layer, and along with the other drainage layers described in the present application, it can replace the drainage layer 210 of the sand control screen assembly 200 described in FIGS. 2A-D and may otherwise be used in the exemplary wellbore system 100 (FIG. 1) depicted therein.

Referring to FIGS. 3A-3D, the drainage layer section 300 is a double dimpled sheet 340 having multiple perforations or openings 345 extending therethough. The sheet 340 can be metallic or non-metallic. Fluid generally flows through the openings 345 in a direction from a top side 340*a* to a bottom side 340*b* of the sheet 340, and towards a base pipe in some embodiments (not shown). The sheet 340 includes multiple dimples 350 protruding out from the top side 340*a* of the sheet 340, and multiple dimples 360 protruding out from the bottom side 340*b* of the sheet 340. Generally, the upper dimples 350 interface with filter medium (not shown) and the lower dimples 360 interface with a base pipe (not shown). In certain exemplary embodiments, the upper dimples 350 have a solid face 350*a*. In other embodiments, the upper dimples 350 could have an opening therethrough. In certain embodiments, the upper dimples 350 are sized to provide an offset D1 between the sheet 340 and a filter medium. In certain exemplary embodiments, the offset D1 can be in a range from about 0.01 inch to about 1.00 inch so as to provide controlled flow distribution in the space formed by the filter medium 215 (FIGS. 2A-2D) and the drainage layer before the flow passes the drainage layer openings 345. In certain exemplary embodiments, the lower dimples 360 have an opening 360*a* extending therethrough, to allow fluid to flow from a filter medium to a base pipe. In certain other embodiments, the lower dimples 360 could have a solid face. In certain embodiments, the lower dimples 360 are sized to provide an offset D2 between the sheet 340 and a base pipe. In certain exemplary embodiments, the offset D2 can be in a range from about 0.01 inch to about 1.00 inch so as to provide controlled flow distribution in the space formed by the drainage layer and the base pipe 205 (FIGS. 2A-2D) before the flow passes the base pipe openings 225 (FIGS. 2A-2D). In addition, while the present figures illustrate cylindrical dimples 350, 360 having a circular profile, one having ordinary skill in the art will recognize that in alternative embodiments, these protrusions can have any profile shape configuration, such as triangular, elliptical, oval, square, rectangular, quatrefoil, curvilinear triangular, trapezoidal, pentagon, hexagon, other polygons, asymmetrical, and the like. One having ordinary skill in the art will also recognize that the dimples 350, 360 can vary in size, number, frequency, arrangement, and the like, from application to application. Also, the dimples 350, 360 can be formed by any means known to one having ordinary skill in the art, including, but not limited to, extrusion, stamping, and insertion of separate parts to openings 345.

FIGS. 4A-4E illustrate an exemplary embodiment of a section 400 of a drainage layer for a sand control screen assembly for use in a wellbore. The drainage layer section 400 may be used to construct a cylindrical-shaped drainage layer, and along with the other drainage layers described in the present application, it can replace the drainage layer 210 of the sand control screen assembly 200 described in FIGS. 2A-D and may otherwise be used in the exemplary wellbore system 100 (FIG. 1) depicted therein. The drainage layer section 400 is the same as that described above with regard to drainage layer section 300, except as specifically stated below. For the sake of brevity, the similarities will not be repeated hereinbelow.

Referring now to FIG. 4A-4E, rather than having lower dimples, the drainage layer section 400 includes a plurality of ribs 460 coupled to a bottom side 440*b* of sheet 440. In certain exemplary embodiments, the ribs 460 have a circular cross-sectional profile, and have a diameter that provides an offset dl between the sheet 440 and a base pipe. In certain exemplary embodiments, the diameter/offset dl can be in the range of from about 0.01 inch to about 1.00 inch. In addition, while the present figures illustrate ribs 460 having a circular cross-sectional profile, one having ordinary skill in the art will recognize that in alternative embodiments, these ribs can have any profile shape configuration, such as triangular, elliptical, oval, square, rectangular, quatrefoil, curvilinear triangular, trapezoidal, pentagon, hexagon, other polygons, asymmetrical, and the like. One having ordinary skill in the art will also recognize that the ribs 460 can vary in size, number, frequency, arrangement, and the like, from application to application. The ribs 460 may be coupled to the sheet 440 in any suitable manner known to one having ordinary skill in the art, such as welding and diffusion bonding.

FIGS. 5A-5E illustrate an exemplary embodiment of a section 500 of a drainage layer for a sand control screen assembly for use in a wellbore. The drainage layer section 500 may be used to construct a cylindrical-shaped drainage layer, and along with the other drainage layers described in the present application, it can replace the drainage layer 210 of the sand control screen assembly 200 described in FIGS. 2A-D and may otherwise be used in the exemplary wellbore system 100 (FIG. 1) depicted therein. The drainage layer section 500 is the same as that described above with regard to drainage layer section 400, except as specifically stated below. For the sake of brevity, the similarities will not be repeated hereinbelow.

Referring now to FIG. 5A-5E, the drainage layer section 500 includes a plurality of ribs 560 coupled to a bottom side 540*b* of sheet 540. In certain exemplary embodiments, the ribs 560 include one or more channels 570 allow for flow communication between channels. One having ordinary skill in the art will recognize that the channels 570 can have any profile shape configuration, such as arced, square, trapezoidal, other polygons, asymmetrical, and the like. One having ordinary skill in the art will also recognize that the channels 570 can vary in size, number, frequency, arrangement, and the like, from rib to rib, and from application to application. The presence of the channels 570 may allow for controlled flow distribution between the channels formed by the plurality of ribs 560 and the base pipe 205 (FIGS. 2A-2D).

In certain exemplary embodiments, the ribs 560 have a triangular cross-sectional profile, and have a length that provides an offset 51 between the sheet 540 and a base pipe. In certain exemplary embodiments, the length/offset Si can be in the range of from about 0.01 inch to about 1.00 inch. In addition, while the present figures illustrate ribs 560 having a triangular cross-sectional profile, one having ordinary skill in the art will recognize that in alternative embodiments, these ribs can have any profile shape configuration, such as circular, elliptical, oval, square, rectangular, quatrefoil, curvilinear triangular, trapezoidal, pentagon, hexagon, other polygons, asymmetrical, and the like. One having ordinary skill in the art will also recognize that the ribs 560 can vary in size, number, frequency, arrangement, and the like, from application to application. The ribs 560 may be coupled to the sheet 540 in any suitable manner known to one having ordinary skill in the art, such as welding and diffusion bonding.

Figure 6A:
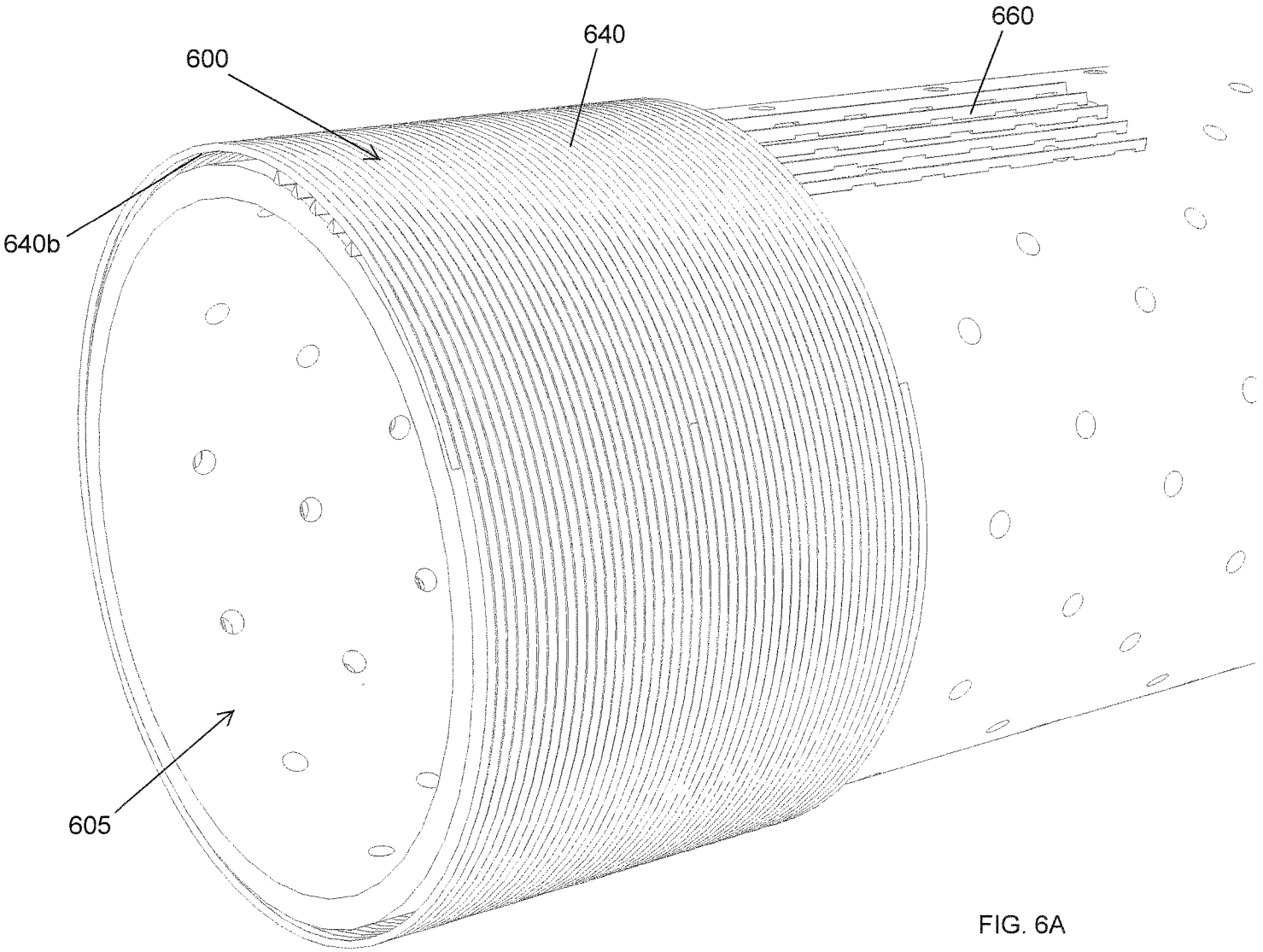
FIG. 6A is a partial perspective view of a wire wrapped drainage layer for a sand control screen assembly, according to an embodiment of the present invention.
Figure 6B:
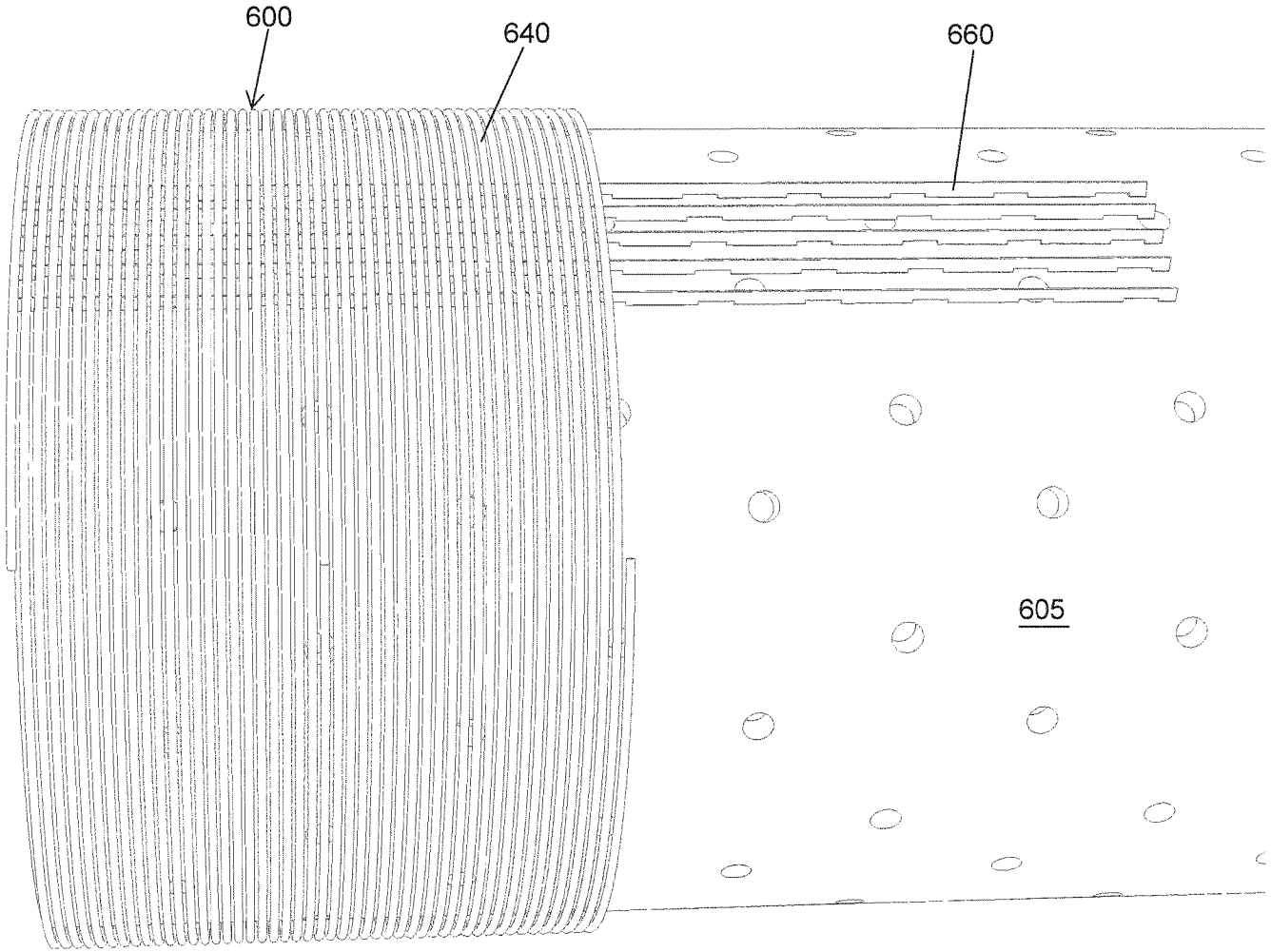
FIG. 6B is a partial side view of the wire wrapped drainage layer of FIG. 6A, according to an embodiment of the present invention.

FIGS. 6A-6B illustrate an exemplary embodiment of a drainage layer 600 placed around a surface of a perforated base pipe 605 for a sand control screen assembly for use in a wellbore. Some of the components (e.g. ribs 660) are not shown entirely for ease of visualizing and describing the invention with respect to the figures. Along with the other drainage layers described in the present application, the drainage layer 600 can replace the drainage layer 210 of the sand control screen assembly 200 described in FIGS. 2A-D and may otherwise be used in the exemplary wellbore system 100 (FIG. 1) depicted therein. The drainage layer 600 is the same as that described above with regard to drainage layer section 500, except as specifically stated below. For the sake of brevity, the similarities will not be repeated hereinbelow.

Referring now to FIG. 6A-6B, rather than having a sheet with upper dimples protruding therefrom, the drainage layer 600 is a wire-wrapped screen-type porous medium 640 having a plurality of ribs 660 coupled to a bottom side 640*b* of porous medium 640. In certain exemplary embodiments, the ribs 660 are similar to ribs 560. The ribs 660 may be coupled to the screen 640 in any suitable manner known to one having ordinary skill in the art, such as welding and diffusion bonding. In certain other embodiments, the drainage layer 600 alone can work as a filtration medium when designed or manufactured for such purposes without a separate filter medium.

Figure 7A:
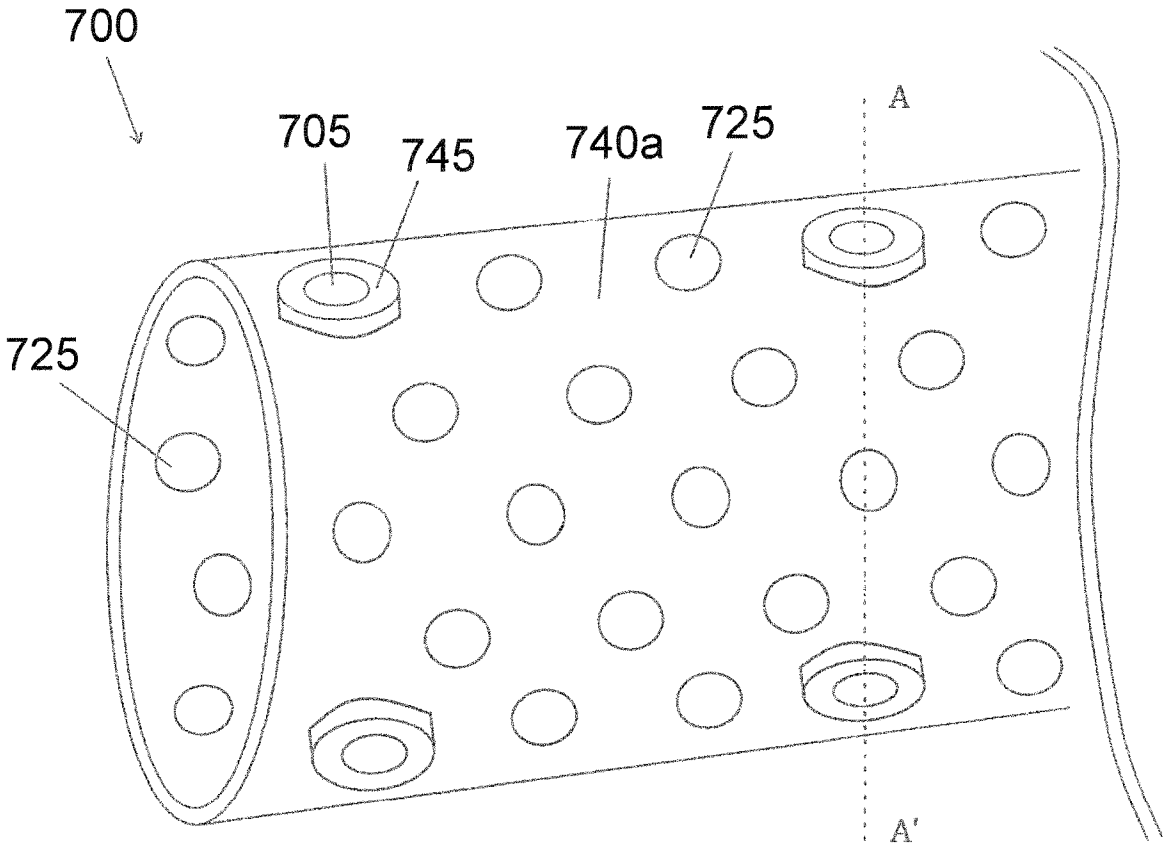
FIG. 7A is a top perspective view of a drainage layer for a sand control screen assembly, according to an embodiment of the present invention.
Figure 7B:
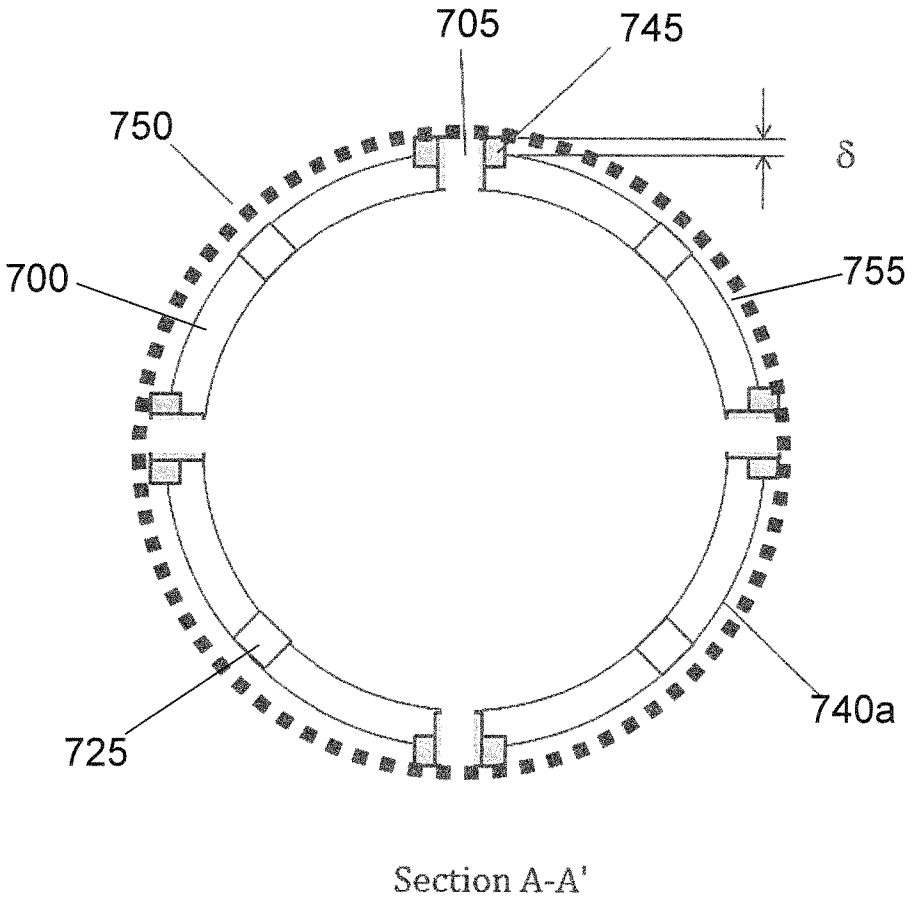
FIG. 7B is a side cross-sectional view of the drainage layer of FIG. 7A, according to an embodiment of the present invention.

FIGS. 7A-7B illustrate an exemplary embodiment of a drainage layer 700 for a sand control screen assembly for use in a wellbore. Along with the other drainage layers described in the present application, the drainage layer 700 may replace the drainage layer 210 of the sand control screen assembly 200 described in FIGS. 2A-D and may otherwise be used in the exemplary wellbore system 100 (FIG. 1) depicted therein.

The drainage layer 700 is a perforated tube 740 that includes one or more openings 725, some of which having an insert 745 positioned therein on the side proximate an outer wall 740*a* of the drainage layer 700. The inserts 745 may include an internal opening 705 that allows for flow communication directly from the exterior of filter medium or supportive structure 750 (FIG. 7B) towards the interior of the drainage layer 700. Referring to FIG. 7B, the inserts 745 essentially provide an offset 6 such that when a filter medium or supportive structure 750 is positioned about the drainage layer 700, the additional offset 6 forms a widely open channel 755 between the base pipe outer surface 740*a* and the filter medium or supportive structure 750, and therefore results in unhindered flow distribution between openings 725. The inserts 745 can be sectioned or slotted to allow for flow communication between the channel 755 and the interior of the drainage layer 700. In certain alternative embodiments, the inserts 745 may have a solid face to prevent flow of fluid therethrough. In addition, in some embodiments, the drainage layer may have additional inserts (not shown) that extend from a bottom or inner side 740*b* of the drainage layer tube 740 to provide an offset between the drainage layer and the base pipe.

While the present embodiment illustrates an insert having a circular shape in the planar top view, one having ordinary skill in the art will recognize that the inserts 745 may have any shape configuration that allows for flow communication to openings 725, and provide an offset 6 from the outer wall 740*a*. For instance, the planar top view profile of the inserts 745 can have any shape configuration, such as triangular, floral, elliptical, oval, square, quatrefoil, curvilinear triangular, rectangular, trapezoidal, pentagon, hexagon, other polygons, asymmetrical, and the like. The inserts 745 may be constructed from any material suitable for use with the screen assemblies of the present invention in a downhole environment, and may include erodible materials with tracers and/or fibers, the same material as the underlying drainage layer 700, a high temperature erosion resistant material (such as cobalt based alloys and carbides), a coated or hardened material, plastics suitable for use as metal replacements, and the like. These inserts may be press-fit, bolted, or riveted into the holes of the base pipe.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sand control screen assembly, comprising:

a base pipe having openings through a thickness of the base pipe;

a perforated drainage layer disposed about the base pipe;

a filter medium positioned about the perforated drainage layer;

a plurality of continuous ribs disposed between the perforated drainage layer and the filter medium, wherein the plurality of continuous ribs are aligned with respect to each other to form a plurality of first channels therebetween, wherein at least some continuous ribs of the plurality of continuous ribs comprise at least one cutout that traverses a width of the at least some continuous ribs, wherein the at least one cutout forms a second channel that allows for flow communication between adjacent first channels on either side of the at least some continuous ribs; and a shroud disposed about the filter medium.

2. The sand control screen assembly of claim 1, wherein the plurality of continuous ribs are coupled to and extend from an inner surface of the filter medium.

3. The sand control screen assembly of claim 1, wherein the plurality of continuous ribs are coupled to and extend from an outer surface of the perforated drainage layer.

4. The sand control screen assembly of claim 1, wherein the plurality of continuous ribs provide substantially uniform radial spacing between the perforated drainage layer and the filter medium.

5. The sand control screen assembly of claim 1, wherein the plurality of continuous ribs have a profile shape configuration selected from a group consisting of circular, triangular, elliptical, oval, square, rectangular, quatrefoil, curvilinear triangular, trapezoidal, pentagon, hexagon, other polygons, and asymmetrical.

6. The sand control screen assembly of claim 1, wherein the plurality of continuous ribs are formed by extrusion, stamping, or insertion of separate parts into perforations of the perforated drainage layer.

7. The sand control screen assembly of claim 1, wherein the plurality of continuous ribs and the base pipe have a substantially similar length.

8. A sand control screen assembly, comprising:

a base pipe having openings through a thickness of the base pipe;

a drainage layer disposed about the base pipe;

a filter medium positioned about the drainage layer;

a shroud disposed about the filter medium; and a plurality of continuous ribs for providing a first substantially uniform radial spacing between an inner surface of the drainage layer and an outer surface of the base pipe, wherein the plurality of continuous ribs are aligned with respect to each other to form a plurality of first flow channels therebetween, and wherein at least some of the plurality of continuous ribs comprise at least one cutout that traverses a width of the at least some continuous ribs, wherein the at least one cutout forms a second channel that allows for flow communication between adjacent first flow channels on either side of the at least some of the plurality of continuous ribs.

9. The sand control screen assembly of claim 8, further comprising:

a second plurality of continuous ribs for providing a second substantially uniform radial spacing between the drainage layer and the filter medium when the sand control screen assembly is in use.

10. The sand control screen assembly of claim 8, wherein the plurality of continuous ribs are oriented longitudinally, circumferentially, or helically along the inner surface of the drainage layer.

11. The sand control screen assembly of claim 8, wherein the plurality of continuous ribs provides a radial spacing in a range from about 0.01 inch to about 1.00 inch.

12. The sand control screen assembly of claim 8, wherein the plurality of continuous ribs have a profile shape configuration selected from a group consisting of triangular, elliptical, oval, square, rectangular, quatrefoil, curvilinear triangular, trapezoidal, pentagon, hexagon, other polygons, and asymmetrical.

13. The sand control screen assembly of claim 8, wherein the plurality of continuous ribs are coupled to the inner surface of the drainage layer by welding or diffusion bonding.

14. The sand control screen assembly of claim 8, wherein the plurality of first flow channels have a profile shape configuration selected from a group consisting of arched, square, trapezoidal, other polygons, and asymmetrical.

15. The sand control screen assembly of claim 8, wherein a first size, a first number, a first frequency, and/or an arrangement of the at least one cutout in a first continuous rib of the at least some of the plurality of continuous ribs differs from a second size, a second number, a second frequency, and/or an arrangement of the at least one cutout in a second continuous rib of the at least some of the plurality of continuous ribs.

16. The sand control screen assembly of claim 8, wherein the drainage layer is perforated.

17. The sand control screen assembly of claim 8, wherein the drainage layer is a wire-wrapped porous medium.

18. The sand control screen assembly of claim 8, wherein the at least one cutout has a profile shape configuration selected from a group consisting of arched, square, trapezoidal, other polygons, and asymmetrical.

19. The sand control screen assembly of claim 8, wherein the at least one cutout for one rib is configured differently from the at least one cutout for an adjacent rib.

20. A sand control screen assembly, comprising:

a base pipe having openings through a thickness of the base pipe;

a drainage layer having openings through a thickness of the drainage layer, wherein the drainage layer is disposed about the base pipe;

a filter medium disposed about the drainage layer;

a shroud disposed about the filter medium; and a plurality of inserts positioned in and lining at least a portion of at least a subset of the openings of the drainage layer, wherein each insert of the plurality of inserts has an internal aperture extending therethrough that allows for flow communication between a top of the insert and a bottom of the insert, and wherein the plurality of inserts provide a radial offset between the filter medium and the drainage layer and/or between the base pipe and the drainage layer.

21. The sand control screen assembly of claim 20, wherein the the radial offset between the filter medium and the drainage layer is substantially uniform around an outer perimeter of the drainage layer.

22. The sand control screen assembly of claim 20, wherein the radial offset between the base pipe and the drainage layer is substantially uniform around an outer perimeter of the base pipe.

23. The sand control screen assembly of claim 20, wherein the plurality of inserts have a planar top view profile selected from a group consisting of triangular, floral, elliptical, oval, square, quatrefoil, curvilinear triangular, rectangular, trapezoidal, pentagon, hexagon, other polygons, and asymmetrical.

24. The sand control screen assembly of claim 20, wherein the plurality of inserts are constructed using one or more of a group consisting of erodible materials with tracers and/or fibers, a same material as the drainage layer, a high temperature erosion resistant material, a coated or hardened material, and plastics suitable for use as metal replacements.

25. The sand control screen assembly of claim 20, wherein the plurality of inserts are press-fit, bolted, or riveted into the openings of the drainage layer.

* * * * *